US005631690A

United States Patent [19]

Tashiro et al.

[11] Patent Number: 5,631,690

[45] Date of Patent: May 20, 1997

[54] RECORDING APPARATUS

[75] Inventors: Mitsuo Tashiro; Kenji Ogawa, both of Tokyo, Japan

[73] Assignee: Seikosha Precision Inc., Tokyo, Japan

[21] Appl. No.: 374,426

[22] Filed: Jan. 19, 1995

[30] Foreign Application Priority Data

| | | | |
|---|---|---|---|
| Feb. 3, 1994 | [JP] | Japan | 6-011724 |
| Feb. 3, 1994 | [JP] | Japan | 6-011725 |
| Feb. 3, 1994 | [JP] | Japan | 6-011726 |

[51] Int. Cl.[6] ..... B41J 2/32

[52] U.S. Cl. ..... 347/220

[58] Field of Search ..... 347/220, 197, 347/198; 400/120.16, 120.17

[56] References Cited

U.S. PATENT DOCUMENTS

| | | | |
|---|---|---|---|
| 5,014,073 | 5/1991 | Sone et al. | 347/198 |
| 5,414,450 | 5/1995 | Oshino et al. | 347/197 |

FOREIGN PATENT DOCUMENTS

| | | | |
|---|---|---|---|
| 4-156374 | 5/1992 | Japan | 347/198 |

*Primary Examiner*—Huan H. Tran

*Attorney, Agent, or Firm*—Amster, Rothstein & Ebenstein

[57] ABSTRACT

A recording apparatus includes a head support plate engageable with the rear end of a support shaft of a support frame; a print head carried on the head support plate; an operable member rotatably connected to the support frame; a platen rotatably provided on the operable member so as to face the print head when the operable member is in a closed position; a regulating plate integral with the head support plate and contactable with the platen shaft when the operable member is in a closed position; and actuating lever rotatable on the support frame and engageable with the head support plate; and a biasing spring. The biasing spring is laid among the support frame, the head support plate and the actuating lever for biasing a force in a direction in which the print head is brought into elastic contact with the platen and the regulating plate is biased toward the platen shaft when the operable member is in the closed position, and at the same time for biasing the force in a direction in which the print head is separated away from the platen when the operable member is in an opened position.

6 Claims, 8 Drawing Sheets

RECORDING APPARATUS

BACKGROUND OF THE INVENTION

1. Field of the Industrial Application

The present invention relates to a recording apparatus in a printer for printing information on a thermal paper by using, for example, a thermal head.

2. Prior Art

In a first conventional recording apparatus, there are provided a recording head that is elastically contacted with a platen by a spring, a release lever 1 swingably mounted on a head supporting plate for supporting the recording lever, a connecting member that shifts in cooperation with the swing motion of the release lever, and a release cam drivingly swung in accordance with a shift of the connecting member. By manually swinging the release lever, in the non-used condition, in order to prevent any deformation of the platen, the recording head may be kept away from the platen (Japanese Utility Model Application Laid-Open No. Hei 2-139752).

In a second conventional recording apparatus, a recording head is provided in an interior of a case body, and a platen and a roll holder for receiving and holding a roll of recording paper are openably provided in a front surface of the case body, respectively.

In a third conventional thermal print head, a head base plate having heating dots (recording head) is provided on a base plate, on one hand, a terminal portion of the head base plate is pressed and fixed by a pressing cover, and on the other hand, a positioning piece having engaging grooves engaged with a shaft of the platen are bent and integrally formed (Japanese Patent Examined Publication No. Hei 5-7187).

In such a first conventional apparatus where the release lever is manually swingably driven to separate the recording head from the platen, there are only two conditions where the recording head and the platen are elastically contacted with each other and are separated away from each other. In the condition where the recording head is separated away from the platen, i.e., the recording stand-by condition, it is impossible to feed the recording paper.

Also, in the first conventional apparatus, in order to separate the recording head away from the platen, it is necessary to swingably drive the release lever. For this reason, even if the recording operation is completed, if the user forgets the operation to separate the recording head away from the platen, the condition where the recording head is pressingly contacted with the platen is kept for a long period of time. As a result, there is a high fear that the pressure of the recording head against the platen would cause the platen to be deformed.

In a structure in which the roll holder and the platen are provided on the side of the front cover as in the second conventional apparatus, when the rolls of recording paper are replaced, it is sufficient to open the front cover and to close the front cover after setting the roll of recording paper with its end overlapping over the platen. Thus, the loading operation of the recording paper is simple. However, for example, when the front cover is opened, it is necessary to manually or electrically separate the recording head, located on the side of the case body, away from the platen to thereby eliminate the contact between the recording head and the platen in the opening/closing operation and to protect the platen from a damage caused by the friction. In the case where the apparatus is so constructed as to meet this requirement, a number of components are required and its structure is complicated to increase a cost. Also, in the second conventional apparatus, as in the first conventional apparatus, in the condition where the recording head is separated away from the platen, i.e., the recording stand-by condition, it is impossible to feed the paper.

Also, in the structure where the roll holder and the platen are provided on the side of the front cover as in the second conventional apparatus, the recording paper loading operation is simple but it is necessary to increase a relative positional precision between the recording head and the platen after the front cover has been closed. In order to enhance the relative positional precision between the recording head and the platen, it is necessary to control the component precision of a number of individual components needed for supporting the printing head and the platen and the assembling precision therefor at a high level.

Also, in the second conventional apparatus, in opening the opening/closing member, the recording head and the platen are separated away from each other. Accordingly, the substantial pressure for the recording must be applied when the recording condition is available after the opening/closing member has been closed. In addition, the opening/closing member must be prevented from accidentally opening during the recording operation.

In the apparatus in which the heating dots (recording head) and the engaging grooves engaged with the shaft of the platen are formed on the same member (i.e., base plate) as in the third conventional thermal head, it is possible to exactly position the platen relative to the heating dots and to hold them without any adverse affect on the mounting precision or a degree of true circle of the surface. However, in such a structure, it is impossible to provide the platen on the side of the opening/closing member such as an openable front cover in which the recording head is separated away from the platen. As a result, the operation such as replacement of the recording paper rolls becomes extremely complicated, and the loading operation of the recording paper is extremely troublesome.

SUMMARY OF THE INVENTION

A first object of the invention is to simplify a structure to realize a loading operation of recording paper without damaging a platen by separating a printing head away from the platen.

A second object of the invention is to provide a recording apparatus which can feed the recording paper even in a recording stand-by condition by pressing the recording head against the platen at a fine pressure (preliminary pressure) in the recording stand-by condition.

A third object of the invention is to provide a recording apparatus which may enhance the relative positional precision between the printing head and the platen in the simple structure in which the platen is provided in the operable member.

A fourth object of the invention is to uniformly press the printing head over a full length the platen while attaining the above-described third object.

A fifth object of the invention is to provide which may simply and easily the loading operation of the recording paper while attaining the above-described third object.

A sixth object of the invention is to prevent the deformation of the platen caused by the pressure of the printing head against the platen while automatically attaining the pressure and the pressure release of the printing head relative to the platen.

A seventh object of the invention is to lock the operable member so that the operable member could not be opened during the recording operation, and to continue a stable printing while keeping the high precision of the relative position between the printing head and the platen to enhance the printing quality.

Means for Solving the Problems

According to a first feature of the invention, a head support plate is rotatably engaged at its rear end portion with a clearance relative to a supporting shaft fixed to a supporting frame; a printing head is provided at front end portion of the head supporting plate; an operable member is rotatably connected to the supporting frame; a platen is rotatably provided on the operable member and faces the printing head when the operable member is held in a closed position; a regulating plate is integrally formed with the head support plate and provided to be contactable with a shaft of the platen or a bearing provided on the operable member for rotatably supporting the shaft of the platen when the operable member is held in the closed position; an actuating lever is rotatably mounted on the supporting frame and engaging with a part of the head support plate; a regulating portion is provided on the operable member and contactable with the actuating lever when the operable member is held in the closed position; and a biasing spring is laid among the supporting frame, the head support plate and the actuating lever for biasing a spring force in a direction in which the printing head is brought into elastic contact with the platen through the head support plate and in a direction in which the regulating plate is biased toward the shaft of the platen or the bearing when the operable member is held in the closed position, and at the same time for biasing the spring force in a direction in which the printing head is separated away from the platen through the head support plate when the operable member is held in an opened position.

According to a second feature of the invention, the operable member is provided with a holder for a roll of recording paper.

According to a third feature of the invention, the recording apparatus further comprises a pressure means for pressing the head support plate so as to elastically contact the printing head against the platen when the operable member is held in the closed position.

According to a fourth feature of the invention, the pressure means is rotatably provided on the supporting frame and provided with a pair of head press plates for pressing a top surface of the head support plate at a symmetrical position with respect to a boundary line that divides the platen into two sections perpendicular to an axial direction of the platen.

According to a fifth feature of the invention, the recording apparatus further comprises: a pressure spring for biasing the head press plate in a direction in which the printing head is elastically contacted with the platen through the head support plate; a pressure change cam for switching the head press plate between a pressure position in which it engages with the head support plate and a pressure release position in which it is separated away from the head support plate; and a driving means for drivingly rotating the pressure change cam and holding its position in order to switch the head press plate to the pressure position in which the head press plate is engaged with the head support plate while receiving a recording start signal and for drivingly rotate the pressure change cam in order to change the head press plate to the pressure release position away from the head support plate in accordance with the completion of the recording operation.

According to a sixth feature of the invention, a locking member engaged at its one end portion with the operable member for restricting the opening of the operable member relative to the supporting frame is rotatably mounted on the supporting frame, and a locking change cam engaged with the other end portion of the locking member upon the engagement between the pressure change cam and the head press plate and releasing the engagement between the one end portion of the locking member and the operable member is provided.

PREFERRED EMBODIMENT OF THE INVENTION

Figure 1:
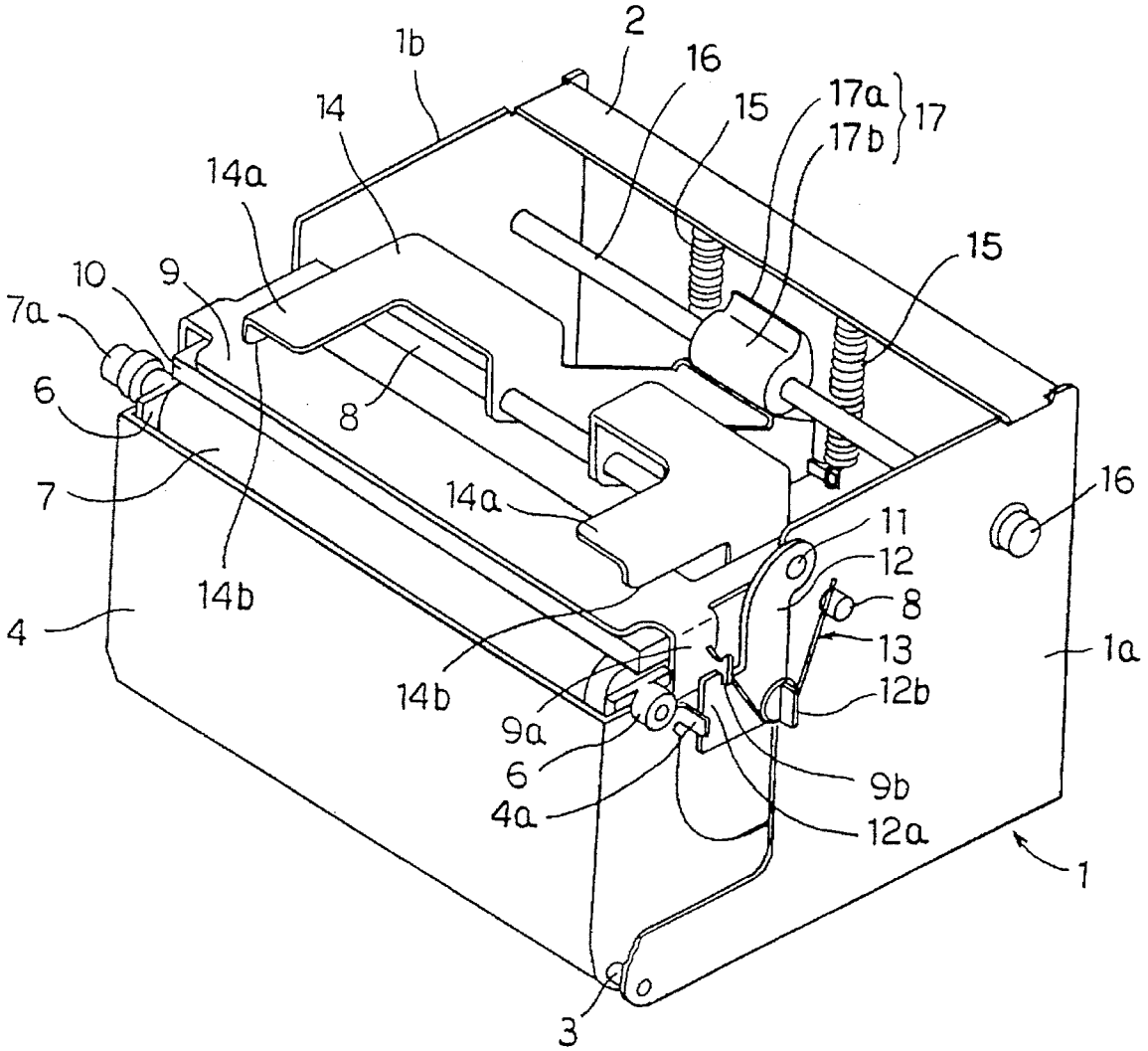
FIG. 1 is a perspective view showing one embodiment of the invention.

The overall structure of the apparatus will now be described with reference to FIGS. 1 and 2.

A supporting frame 1 made from a metal plate is bent into a U-shape. A right side plate 1*a* and a left side plate 1*b* are integrally formed with a bottom plate 1*c*. In order to keep the right side plate 1*a* and the left side plate 1*b* in parallel at a predetermined interval, a stationary plate 2 is fixed to rear upper portions of the two side plates 1*a* and 1*b*. A shaft 3 having a circular shape in cross section is provided transversely in a right and left direction at a front end lower corner of the supporting frame 1.

An operable member 4 having an L-shape in side elevation and covering the front face of the supporting frame 1 is pivotally supported to the shaft 3. A spring 30 (see FIG. 3) is interposed between the supporting frame 1 and the operable member 4 through the shaft 3 so that the operable member 4 is biased in an opening direction by the spring force of the spring 30.

Figure 5:
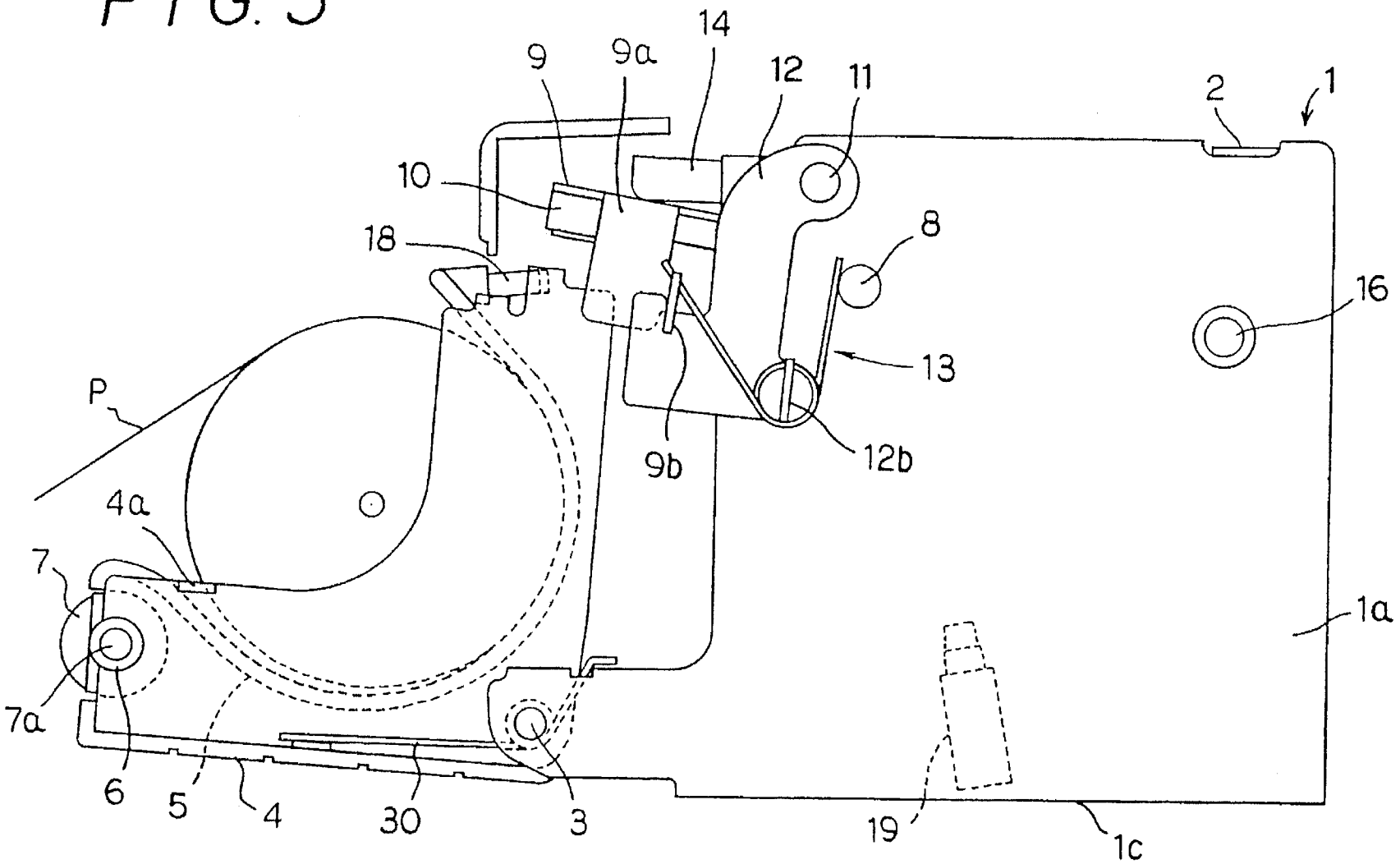
FIG. 5 is a right side view showing a condition that the operable member is fully opened.
Figure 6:
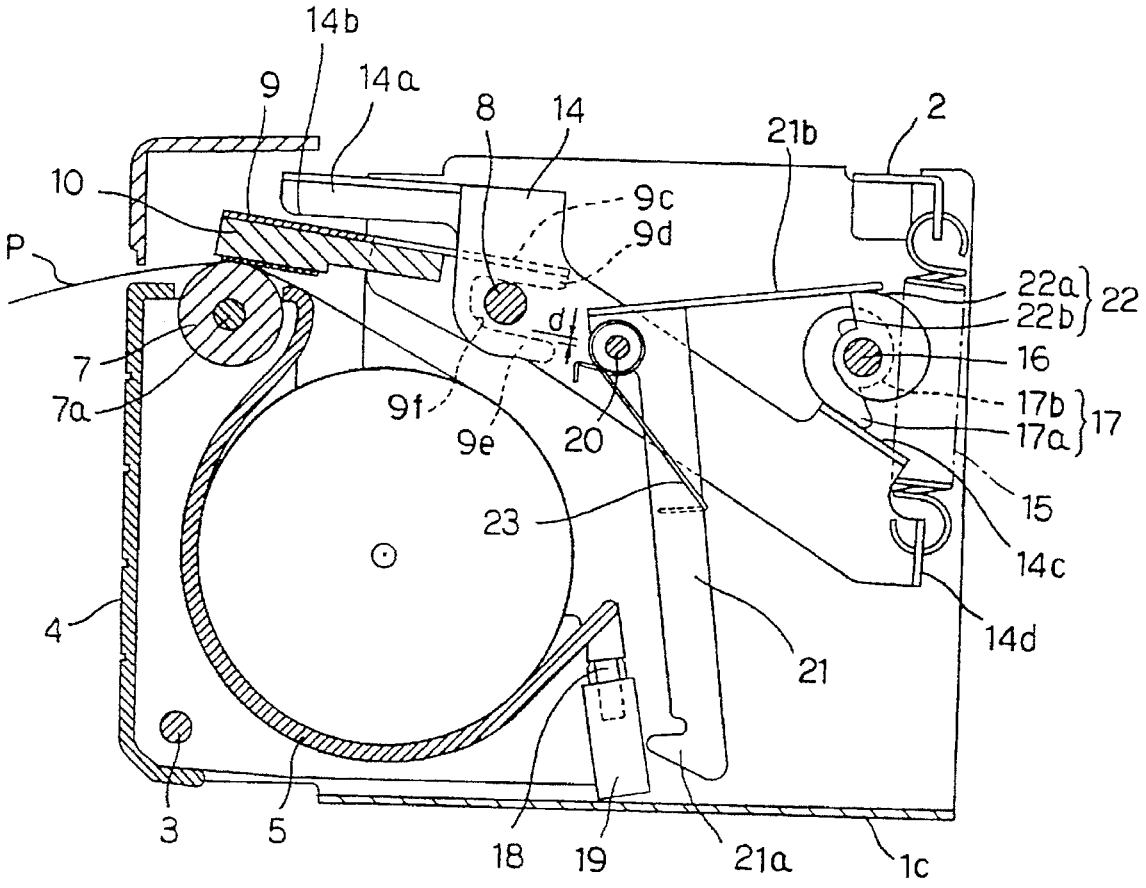
FIG. 6 is a cross-sectional view showing a condition that the printing head is not strongly pressed.

A recording paper holder 5 (see FIG. 5) is provided within an inner surface of the operable member 4 for receiving and holding the recording paper P. An engaging portion 4*b* formed at the rear end portion of the operable member 4 is engaged with the rear end lower surface of the recording paper holder 5 so that the recording paper holder 5 is fixedly held to the operable member 4. A pair of bearings 6 are fixed to the upper end portion of the operable member 4. A platen shaft 7*a* is rotatably supported to the pair of bearings 6. A cylindrical platen 7 formed of a silicone rubber is provided on the platen shaft 7*a*. Regulating portions 4*a* to be described later are bent and formed in the operable member 4 in the vicinity of the bearings 6. As shown in FIGS. 5 and 6, as a means for holding the closed condition of the operable member 4, an engaging protrusion 18 is formed to project from the rear edge of the recording paper holder 5, and a push latch 19 is provided to slant obliquely forwardly for engaging with the engaging protrusion 18 on the bottom plate 1*c* side.

Figure 2:
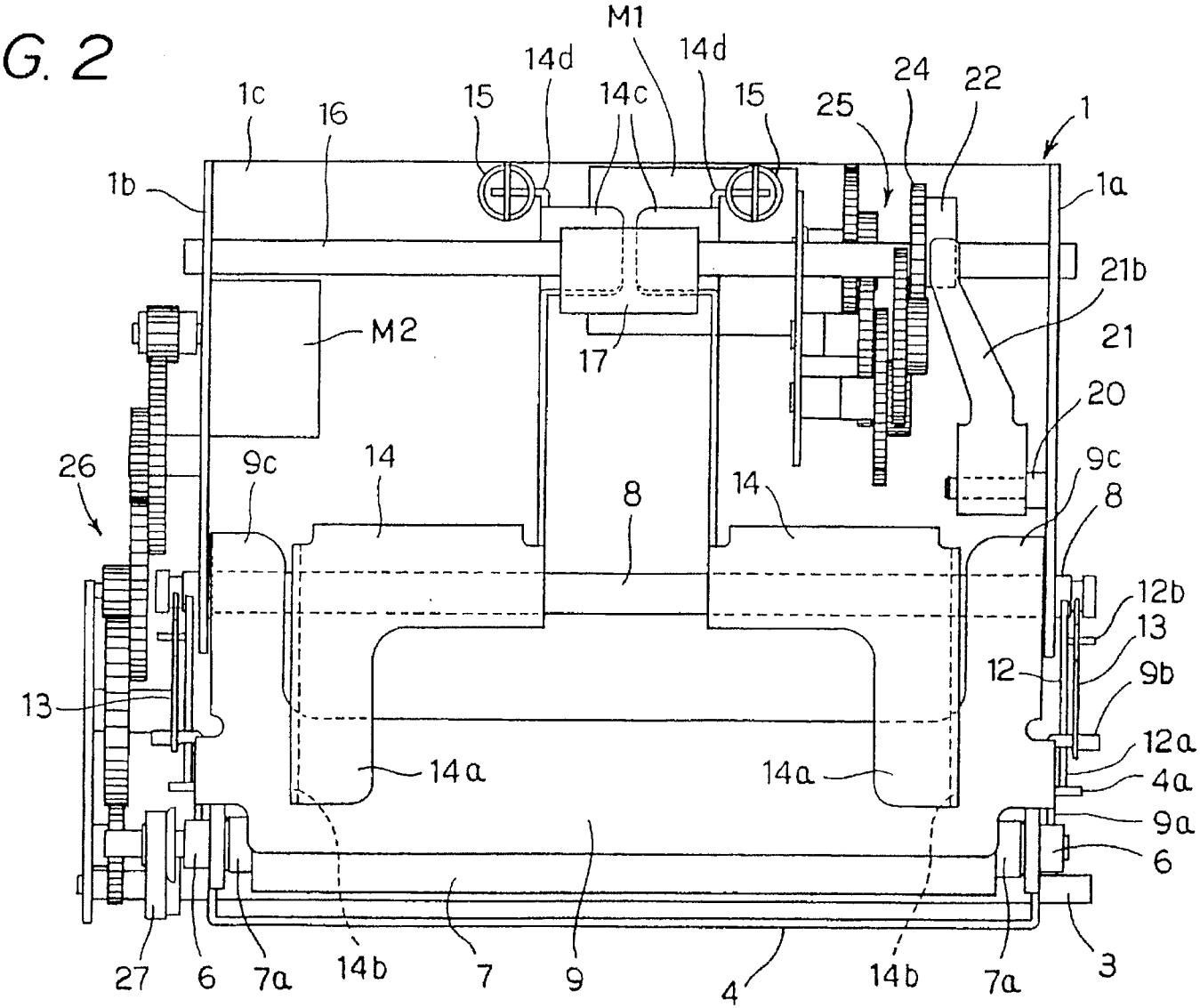
FIG. 2 is a plan view of the same.

A supporting shaft 8 having a circular shape in cross-section is fixedly provided across a central upper portion between the two side plates 1*a* and 1*b* of the support frame 1 (FIG. 2). A head support plate 9 is engaged with the supporting shaft 8 in the following manner.

As shown in FIG. 6, tongue portions 9*d* and 9*e* is formed to be bent at the opposite portions of a supporting portion 9*c* located at the rear end portion of the head support plate 9. A U-shaped hole 9*f* defined by the two tongue portions 9*d* and 9*e* is engaged with the supporting shaft 8 with a predetermined clearance d relative to the lower portion of the supporting shaft 8. Accordingly, the supporting portion 9*c* of the head support plate 9 is pivotally engaged with the fixed supporting shaft 8 and movable in an allowable range defined by the clearance d.

A thermal type printing head (thermal head) 10 in which heating elements (not shown) corresponding to one line are arranged in a lateral direction in a single row at a fine pitch is formed in a front end lower surface of the head support plate 9.

Next, a means for imparting a light friction between the printing head 10 and the platen 7, thus holding the printing head 10 and the platen 7 with an increased relative positional precision, i.e., a means for maintaining such a fine pressurized condition (preliminary pressurized condition) that the platen 7 itself would not be deformed relative to the printing head 10 will described with reference to FIGS. 1 and 3. Incidentally, it should be noted that FIG. 3 just shows a right side surface of the present apparatus but the same structure as that on the right side is provided on the left side.

Figure 3:
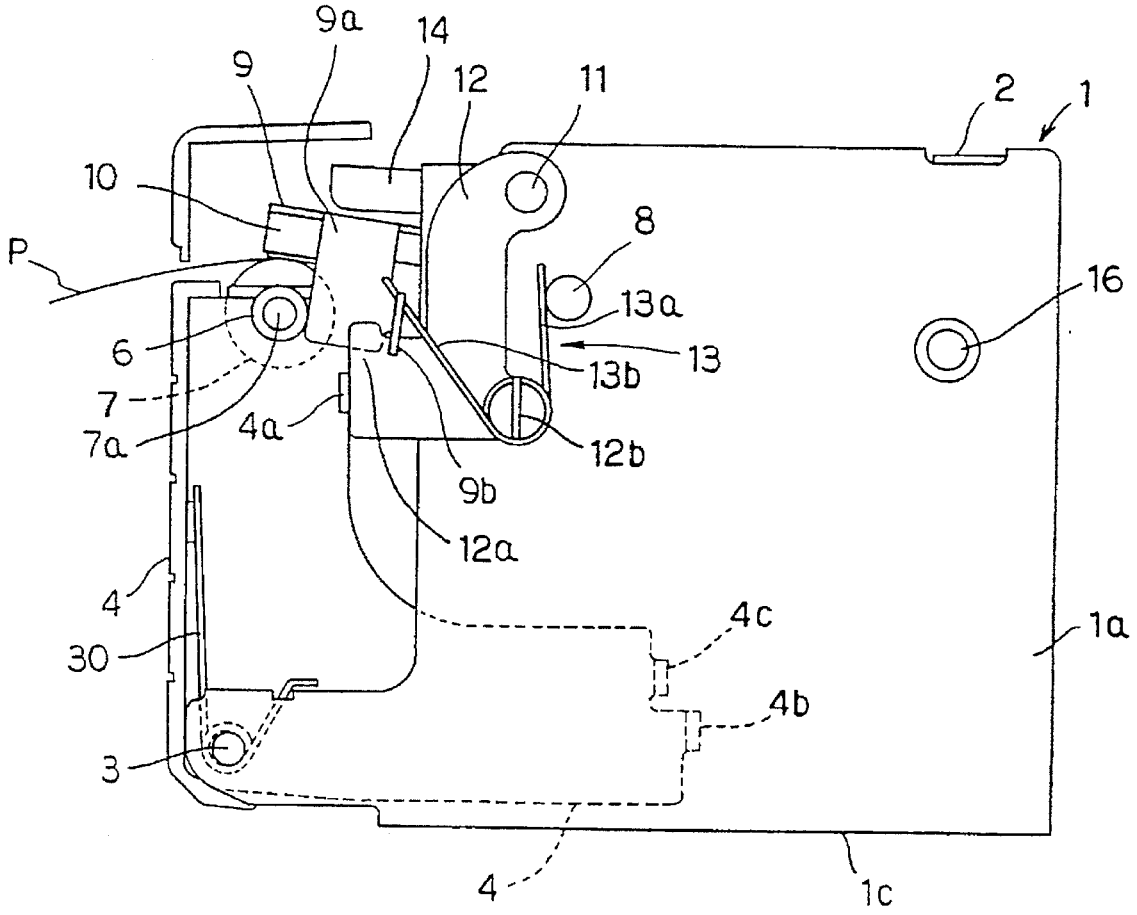
FIG. 3 is a right side view of the same.

As shown in FIGS. 1 and 3, the regulating plates 9*a* are formed to be bent downwardly on both sides of the head support plate 9. Each of the regulating plates 9*a* is further bent laterally to form the engaging portion 9*b*. Each of the engaging portions 9*b* is engaged with an upper side of an engaging portion 12*a* of an actuating lever 12. Front end sides of the regulating plates 9*a* may come into contact with outer circumferential surfaces of the pair of bearings 6 provided on the operable member 4 when the operable member 4 is held in the closed position (i.e., the condition of FIG. 3).

As shown in FIGS. 1 and 3, pins 11 are provided on both side plates 1*a* and 1*b* of the supporting frame 1, respectively, and the actuating levers 12 are pivotally supported to the respective pins 11. The actuating levers 12 are provided with engaging portions 12*a*, and the engaging portions 9*b* of the regulating plates 9*a* formed on the head support plate 9 are engaged with the upper sides of the engaging portions 12*a*. Each biasing spring (coiled spring) 13 is provided at its central portion on a protrusion 12*b* formed and bent from the actuating lever 12. One end portion 13*a* of the biasing spring 13 is hooked at the protrusion end portion of the supporting shaft 8 which is fixed to the supporting frame 1. The other end portion of the biasing spring 13 is hooked to the engaging portion 9*b* of the regulating plate 9*a*. Accordingly, the spring force of the biasing spring 13 is applied in a direction that the one end portion 13*a* of the biasing spring 13 is separated away from the other end portion 13*b* of the biasing spring 13. As a result, the one end portion 13*a* of the biasing spring 13 urges the actuating lever 12 to swing in the clockwise direction about the pin 11. At the same time, the other end portion 13*b* of the biasing spring 13 urges the engaging portion 9*b* to move obliquely downwardly (obliquely downwardly on the left side of FIG. 3).

The front edge of the engaging portion 12*a* of each actuating lever 12 is brought into contact with the regulating portion 4*a* formed and bent from the operable member 4 when the operable member 4 is kept under the closed condition (shown in FIG. 3). In this condition (shown in FIG. 3), the swing motion of the actuating lever 12 in the clockwise direction about the pin 11 is restricted.

With such a structure, when the operable member 4 is kept under the closed condition (shown in FIG. 3), the spring force of the other end portion 13*b* of the biasing spring 13 urges the regulating portion 9*a* of the head support plate 9 obliquely forwardly downwardly (in an obliquely downward direction on the left side in FIG. 3). As a result, the regulating plate 9*a* is brought into contact with the bearing 6, and the printing head 10 is contacted with the platen 7 with a fine pressure to thereby impart a light friction between the two components 10 and 7 for the preliminary pressurized condition. As a result, the printing head 10 is slidably moved forwardly together with the head support plate 9 to exactly face the platen 7, so that the relative position between the printing head 10 and the platen is kept in a high precision level. At the same time, the printing head 10 is finely pressurized against the platen 7 by the biasing spring 13 for the preliminary pressurized condition. This preliminary pressurized condition is so small that the platen 7 per se would not be deformed but enough to feed the recording paper P. The preliminary pressure is set at, for example, 200 gf/full length of the platen (108 mm), so that the light friction is kept between the printing head 10 and the platen 7 and it is possible to feed the paper even in the printing stand-by state.

One end portion 13*a* of the biasing spring 13 should be hooked at a member which has a stationary relationship directly with or indirectly the supporting frame 1. However, it is not always necessary to hook it at the supporting shaft 8.

Also, the front edge of each regulating plate 9*a* of the head supporting plate 9 is brought into contact with the outer circumferential surface of each bearing 6 of the platen shaft 7*a*, to thereby position the printing head 10 relative to the platen 7. However, it is possible to bring the front edge of the regulating plate 9*a* of the head support plate 9 into direct contact with the outer circumferential surface of the platen shaft 7*a*.

Next, a means for separating the printing head 10 from the platen 7 when the operable member 4 is opened will be described.

Figure 4:
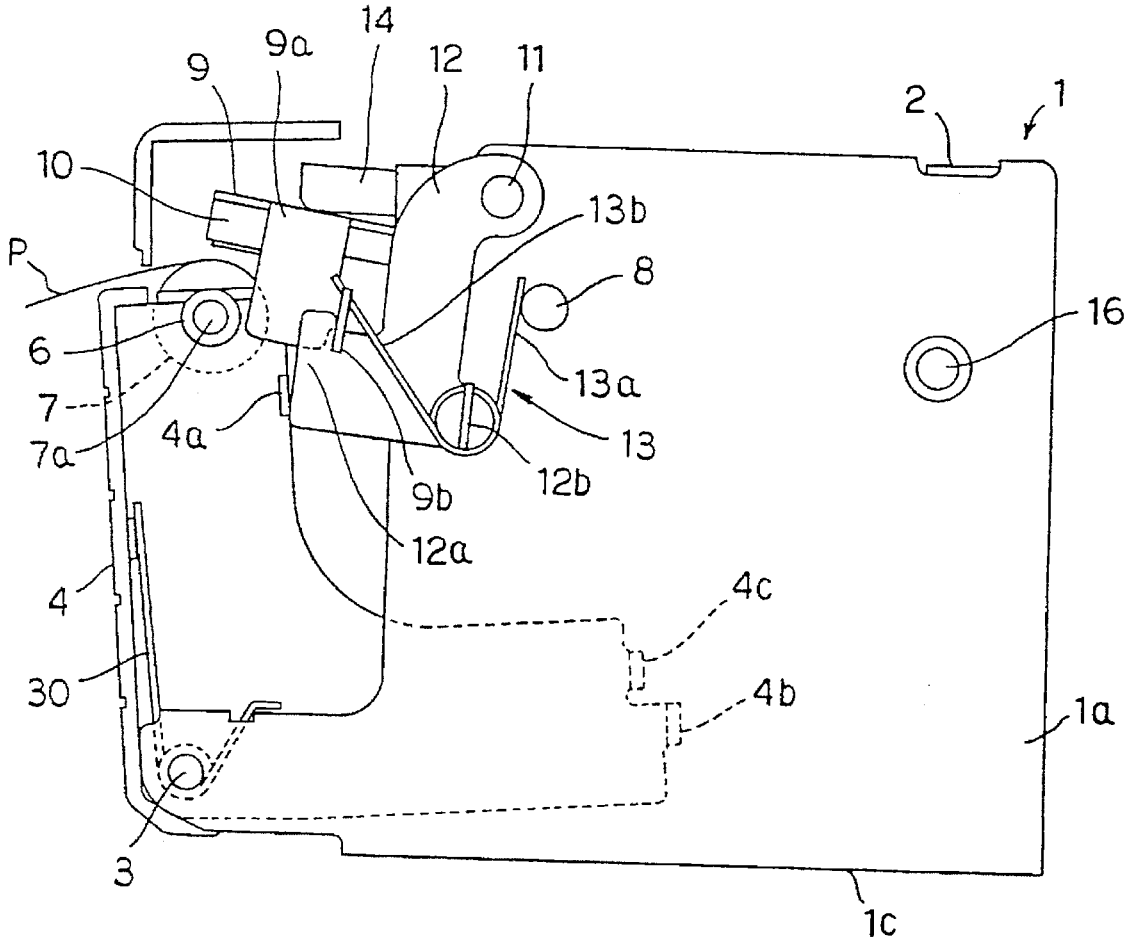
FIG. 4 is a right side view showing an initial condition for opening the operable member.

As shown in FIG. 4, when the operable member 4 starts to be open, the contact between the front edge of each actuating lever 12 and the associated regulating member 4*a* formed and bent from the operable member 4 is released. As a result, the actuating lever 12 is swung in the clockwise direction about the pin 11 while receiving the spring force of the biasing spring 13. The engaging portion 12*a* causes the regulating plate 9*b* to rise upwardly so that the printing head 10 as well as the head support plate 9 is separated away from the platen 7.

With such a structure, when the operable member 4 is opened, since the printing head 10 is separated away from the platen 7, there is no fear that any damage would be applied to both the platen 7 and the printing head 10.

Next, a means for strongly pressurizing the printing head 10 against the platen 7 will be described (for the substantial pressurizing condition).

As shown in FIGS. 2 and 6, a pair of head press plates 14 are pivotally provided on the supporting shaft 8. One end of each head press plate 14 extends forwardly with each lower surface 14*b* facing an upper surface of the head support plate 9. Now, as shown in FIG. 2, each lower surface 14*b* faces the upper surface of the head support plate 9 at a symmetric position with respect to a line (not shown) which is perpendicular to the direction of the shaft 7*a* so as to divide the platen 7 into two sections.

As shown in FIG. 6, the other end 14*c* of each head press plate 14 becomes a surface that extends rearwardly and receives the force for releasing the pressure, i.e., a surface that engages with a cam 17 (to be described later). Each of pressure springs 15 is laid between the rear end portion of each head press plate 14 and the stationary plate 2. The head pressure plate 14 is swung counterclockwise about the pivot center of the supporting shaft 8, is contacted with the upper surface of the head support plate 9 and is elastically urged in a direction for substantially pressurizing the printing head 10 against the platen 7 by the spring force of the spring 15.

Figure 7:
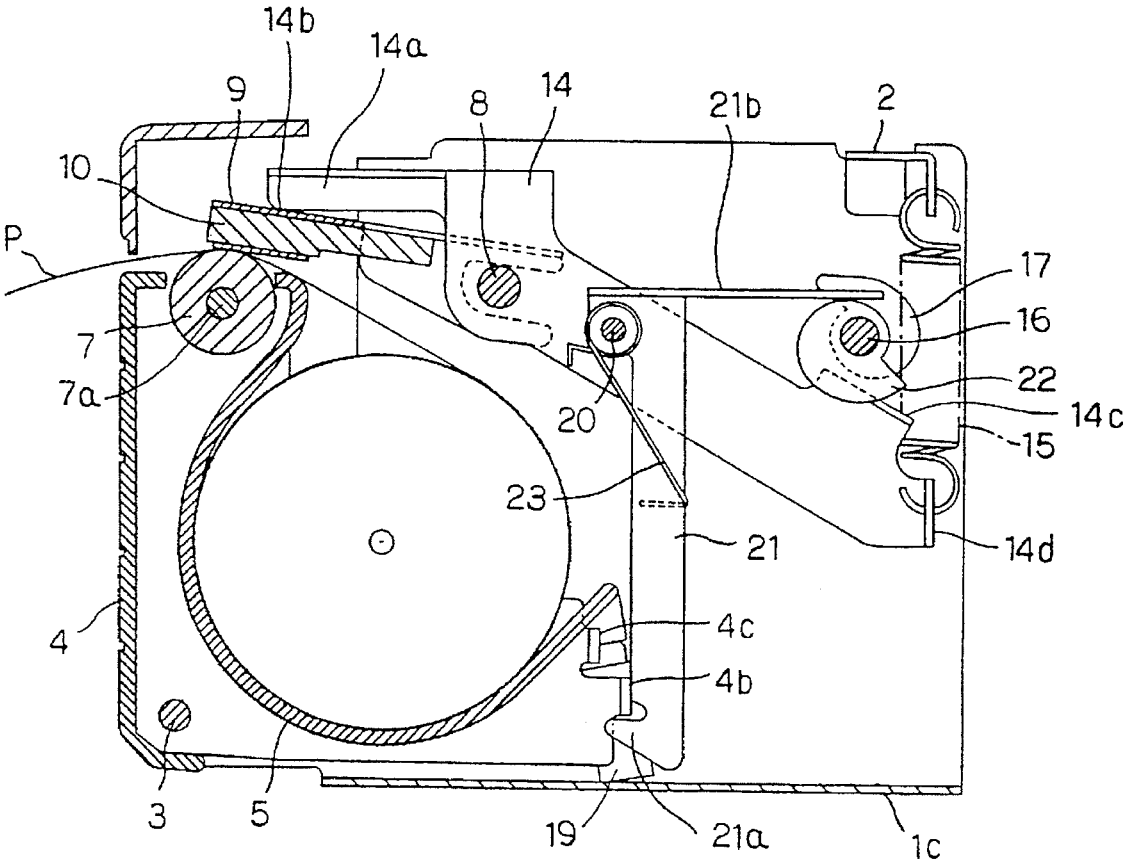
FIG. 7 is a cross-sectional view showing a condition that the printing head is strongly pressed.

With such an arrangement, as shown in FIGS. 2 and 7, receiving the spring force of each pressure spring 15, each lower surface 14*b* pressurizes the upper surface of the head support plate 9 at the symmetric position with respect to a line (not shown) which is perpendicular to the direction of the shaft 7*a* so as to divide the platen 7 into two sections. As a result, even if each component has an error in mechanical precision and assembling precision and the platen 7 is slated relative to the supporting frame 1, since each supporting portion 9*c* of the head support plate 9 is movably and swingably engaged with the fixed supporting shaft 8 within an allowable range defined by the clearance d, the head support plate 9 follows the slant of the platen 7 and presses the latter. It is therefore possible to press the printing head 10 over the full length thereof by the platen 7. The pressure of the printing head 10 against the platen 7 is set at, for example, 2 kgf/platen full length (108 mm). Under this pressure, the apparatus is now brought into the printable condition.

Next, a means for releasing the substantial pressure of the printing head 10 against the platen 7 will be described.

Figure 8:
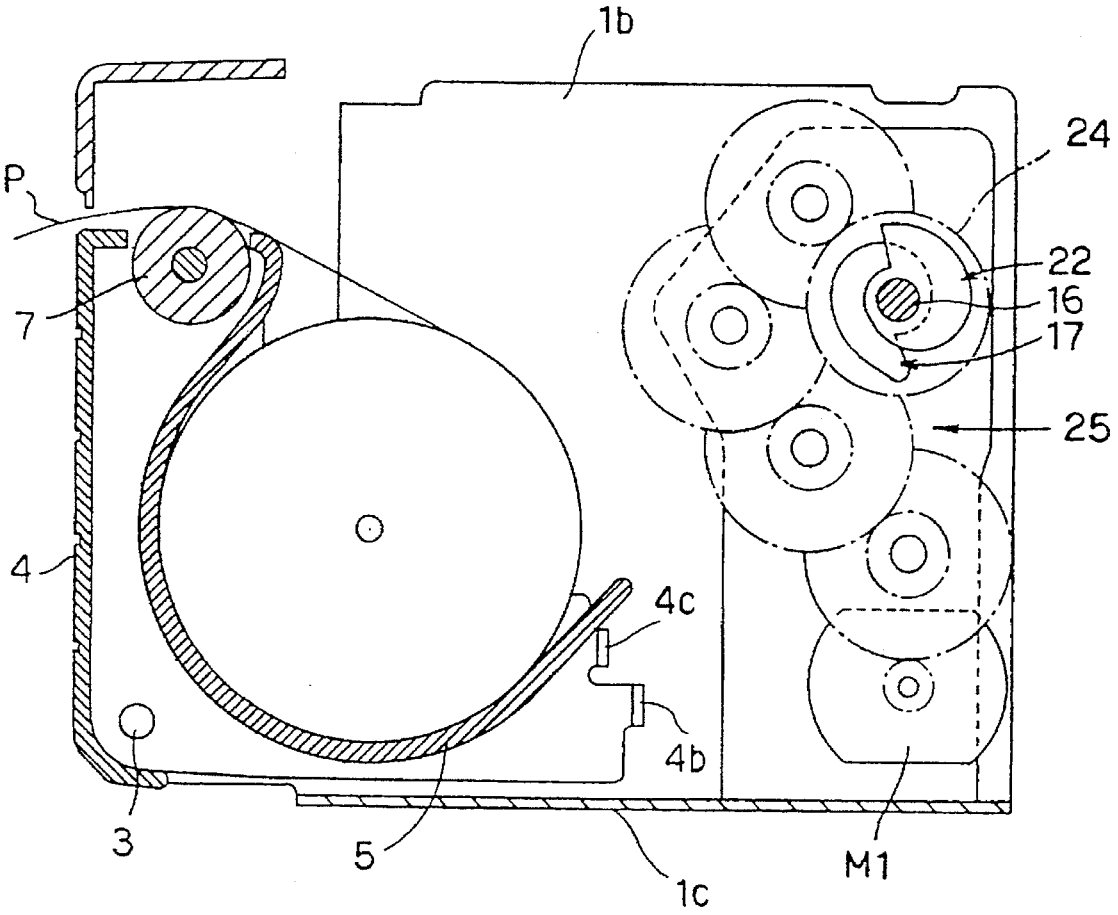
FIG. 8 is a cross-sectional view showing a structure for driving a cam shaft.

As shown in FIGS. 2 and 6, a cam shaft 16 having a circular shape in cross-section and extending across the rear end portions of the two side plates 1*a* and 1*b* of the supporting frame 1. A pressure change cam 17 is fixed to the cam shaft 16. The pressure change cam 17 faces the other end portion 14*c* of the head press plate 14. Its cam portion is continuous from a large diameter cam portion 17*a* to a small diameter bottom portion 17*b* as defined by a smooth surface (see FIG. 6). Incidentally, as shown in FIG. 8, the cam shaft 16 is driven so as to be forwardly and reversely rotated by a motor M1 as described later. As shown in FIG. 6, in a normal condition (i.e., recording stand-by condition) of the non-recording operation, the large diameter cam portion 17*a* is brought into contact with the other end portion 14*c* of the head press plate 14 to separate the lower surface 14*b* of the head press plate 14 away from the top surface of the head support plate 9 to hold the release condition where the printing head 10 is separated away from the platen 7. Incidentally, a locking change cam 22 to be described later is fixed to the cam shaft 16.

Next, a locking means for locking the operable member 4 from being opened in the recording operation, i.e., when the printing head 10 is pressed against the platen 7 will be described.

As shown in FIGS. 6 and 7, during the recording operation, the operable member 4 is closed. At this time, the engaging portion 18 is engaged with the push latch 19. When the closed operable member 4 is pushed from the front side (the left side in FIG. 6), the engaging portion 18 is disengaged from the push latch 19 and the operable member 4 is opened (in the condition shown in FIG. 5) relative to the supporting frame 1 by the spring force of the spring 30 (see FIG. 3). In the recording operation where the printing is effected by the printing head 10, in order to lock the operable member 4 from opening, as shown in FIGS. 2, 6 and 7, the locking member 21 having the L-shape in cross-section is swingably provided about the pin 20 formed at the right side plate la of the supporting frame 1.

The engaging pawl 21*a* is provided at one end portion of the locking member 21. The engaging pawl 21*a* is engageable with the engaging portion 4*b* formed at the rear end portion of the operable member 4 as shown in FIGS. 3, 4 and 7. The other end portion 21*b* of the locking member 21 is engaged with the cam surface of the locking change cam 22 fixed to the cam shaft 16. A locking spring 23 is supported through the pin 20 to the locking member 21. The locking member 21 is urged clockwise about the pin 20 and the engaging pawl 21*a* is engaged with the engaging portion 4*b* by the spring force of the locking spring 23. At the same time, the other end portion 21*b* is biased in a direction in which the other end portion 21*b* is brought into elastic contact with the locking change cam 22. The cam surface of the locking change cam 22 is continuous from a large diameter cam portion 22*a* to a small diameter bottom portion 22*b* as defined by a smooth surface (see FIG. 6).

In the condition shown in FIG. 6, i..e, in the condition where the head press plate 14 does not substantially press the head support plate 9 (the preliminary pressurized condition), since the other end portion 21*b* of the locking member 21 is engaged with the large diameter cam portion 22*a* of the locking change cam 22, the locking member 21 maintains the condition that the engaging pawl 21*a* thereof is separated away from the engaging portion 4*b* of the operable member 4 against the spring force of the locking spring 23. Under this condition, by pushing the operable member 4 from the front side (the left side in FIG. 6), the engaging protrusion 18 is released from the push latch 19, and the operable member 4 may be opened by the spring force of the spring 30 (see FIG. 3) (the condition shown in FIG. 5).

Under the condition shown in FIG. 7, i.e., the condition of the recording operation in which the head press plate 14 presses the head support plate 9 for substantial pressurized condition, since the other end portion 21*b* of the locking member 21 is engaged with the small diameter bottom portion 22*b* of the locking change cam 22, the locking member 21 maintains the condition that the engaging pawl 21*a* is engaged with the engaging portion 4*b* of the operable member 4 by the spring force of the locking spring 23. Under this condition, even if the operable member 4 is pushed from the front side (the left side in FIG. 6), since the engaging portion 4*b* is prevented from being shifted, the operable member 4 cannot be opened. Namely, the operable member 4 is prevented from opening by the locking member 21.

Next, a positional relation between the locking switch cam 22 and the pressure change cam 17 will be described.

As shown in FIG. 6, under the condition that the large diameter cam portion 17*a* of the pressure change cam 17 is engaged with the other end portion 14*c* of the head press plate 14 and the printing head 10 is not pressed against the platen for the substantial pressurized condition (preliminary pressurized condition), the large diameter cam portion 22*a* of the locking change cam 22 is engaged with the other end portion 21*b* of the locking member 21. At this time, it is possible to open the operable member 4.

As shown in FIG. 7, under the condition that the small diameter bottom portion 17*b* of the pressure change cam 17 faces the other end portion 14*c* of the head press plate 14 and the printing head 10 is pressed against the platen 7 for the substantial pressurized condition, the small diameter bottom portion 22*b* of the locking change cam 22 is engaged with the other end portion 21*b* of the locking member 21. In this case, it is impossible to open the operable member 4.

Next, the structure for drivingly rotating the cam shaft 16 will be described.

As shown in FIGS. 2 and 8, a gear 24 is fixed to the cam shaft 16. The forward/reverse rotational motor M1 is mounted affixedly to the bottom plate 1*c*. The rotation of the motor M1 is transmitted to the gear 24 through a transmission gear train 25, whereby the cam shaft 16 is driven forwardly or reversely.

Incidentally, the pressure change cam 17 and the locking change cam 22 are provided on the same cam shaft 16, but it is possible to modify the arrangement so that a first cam shaft and a second cam shaft are separately provided for the two components, respectively, and the respective cam shafts are separately driven by different drive sources as desired, or are separately drivingly rotated through different transmission mechanisms by the same drive source.

Next, the arrangement for drivingly rotating the platen 7 will be described.

As shown in FIG. 2, a motor M2 is provided affixedly to the left side plate 1*b*. The rotation of the motor M2 is transmitted to the platen shaft 7*a* through a transmission gear train 26 and a belt 27 so that the platen 7 may be drivingly rotated.

Next, the drive timing of the motors M1 and M2 will be described.

By pushing a print button (not shown) connected to the apparatus, first of all, the motor M1 is started, and the cam shaft 16 is drivingly rotated counterclockwise through the transmission gear train 25 (see FIG. 8) from the condition shown in FIG. 6. When the condition reaches the state shown in FIG. 7, the motor M1 is stopped. The stop operation of the Motor M1 is controlled by an output from a photosensor (not shown) arranged to face a slit rotational disc (encoder disc) (not shown) provided on the cam shaft 16 for detecting a rotational angle. When the motor M1 is stopped, the motor M2 is started and the shaft 7*a* of the platen 7 is drivingly rotated in a paper feeding direction through the transmission gear train 26 (see FIG. 2) to thereby perform the printing operation, corresponding to one page, on the recording paper P. Then, when the recording operation is completed for one page, the motor M2 is stopped and the rotation of the platen 7 is stopped. Immediately thereafter, the motor M1 is started to drivingly rotate the cam shaft 16 clockwise from the condition shown in FIG. 7 through the transmission gear train 25. In the condition shown in FIG. 6, the motor M1 is stopped.

The operation for loading the roll of recording paper P onto the apparatus will now be described.

When the operable member 4 is pushed from the front side (the left side shown in FIG. 3) under the condition shown in FIGS. 1 and 3, the engaging protrusion 18 shown in FIG. 6 is released from the push latch 19. Then, the operable member 4 is opened by the spring force of the spring 30 (FIG. 3) to exhibit the condition shown in FIG. 5. When the operable member 4 is kept under the fully open state (shown in FIG. 5), it is possible to load the roll of printing paper P into the recording paper holder 5. In this case, the front edge of the recording paper P is somewhat drawn to be located on the platen 7.

When the operable member 4 is closed from the condition shown in FIG. 5, as described in conjunction with FIG. 3, the printing head 10 is located at the position to exactly face the platen 7. In this closing operation, the front edge of the recording paper is naturally located under the condition that the front edge is passed between the printing head 10 and the platen 7 to the outside as shown in FIG. 6. Under the condition shown in FIG. 6 (preliminary pressurized condition), the engaging protrusion 18 is engaged with the push latch 19 but the engaging pawl 21*a* of the locking member 21 is not engaged with the engaging portion 4*b* of the operable member 4. Also, since the lower surface 14*b* of the one end portion 14*a* of the head press plate 14 does not cause the printing head 10 to press the platen 7 for the substantial pressurized condition, this is not the recordable condition on the recording paper P but the recording standby condition.

Under the condition (preliminary pressurized condition), since the cam portion 17*a* of the pressure change cam 17 presses the other end portion 14*d* of the head press plate 14, the one end portion 14*a* is separated away from the head support plate 9. Also, since the cam portion 22*a* of the locking change cam 22 raises the other end portion 21*b* of the locking member 21, the engaging pawl 21*a* of the locking member 21 is not engaged with the engaging portion 4*b* of the operable member 4. Accordingly, when the motor M1 is driven and the cam shaft 16 is rotated counterclockwise, the pressure change cam 17 and the locking change cam 22 are both rotated counterclockwise.

As shown in FIG. 7, when the cam portion 17*a* of the pressure change cam 17 releases the pressure against the other portions 14*c* of the head press plates 14, both head press plates 14 are swung counterclockwise about the supporting shaft 8 by the spring force of the pressure springs 15, and the lower surfaces 14*b* of the one end portions 14*a* of both head press plates 14 strongly elastically press the printing head 10 uniformly in the direction of the longitudinal direction of the platen 7 (for substantial pressurized pressure). The pressure at this time is set to, for example, 2 kgf/platen width (108 mm). With the substantial pressure, it is possible to provide the printable condition.

Furthermore, by rotating the cam shaft 16 counterclockwise as described above, the cam portion 22*a* of the locking change cam 22 is separated from the other end portion 21*b* of the locking member 21 and the locking member 21 is swung clockwise about the pin 20 by the spring force of the locking spring 23. Therefore, since the engaging pawl 21*a* is engaged with the engaging portion 4*b*, it is no longer possible to push the operable member 4 rearwardly. The operable member 4 is kept under the non-operable condition. Accordingly, during the printing operation, there is no fear that the operable member 4 would be accidentally opened and it is possible to perform a stable recording operation.

Upon the completion of the recording operation, the motor M1 is again driven and the pressure change cam 17 and the locking change cam 22 are rotated so that the respective cam portions 17*a* and 22*a* are engaged with the other end portions 14*c* and 21*b* back to the condition shown in FIG. 6. It is therefore possible to replace the rolls of the recording paper P.

Under the condition shown in FIG. 6, since the printing head 10 is brought into the preliminary pressurized condition in which it is finely pressurized against the platen 7 by the biasing spring 13, a friction is imparted between the printing head 10 and the platen 7 to thereby enable the paper feed.

Also, in the condition shown in FIG. 6, the head press plates 14 do not strongly press the head support plate 9, and the condition is the preliminary pressurized condition such that the platen 7 itself is not deformed. It is therefore possible to avoid the deformation of the platen 7 due to the strong pressure over a long time against the platen 7.

EFFECT OF THE INVENTION

As described above, according to the present invention, in the loading operation of the recording paper, the printing head and the platen which have been brought into contact with each other may be automatically separated only by pushing the operable member from the front side. It is possible to realize the loading of the recording paper without any damage to the platen with a simple structure.

Also, in the recording stand-by condition, the printing head and the platen are brought into the finely pressing contact with each other so that a light friction are imparted to the two components. It is therefore possible to feed the recording paper.

Also, when the operable member is kept in the closed condition, the regulating plate formed integrally with the head support plate can contact with a shaft of the platen or the bearing provided on the operable member for rotatably supporting the shaft of the platen and the regulating plate is biased toward the shaft of the platen or the bearing by the biasing member. It is therefore possible to automatically enhance the relative positional precision between the printing head and the platen to thereby enhance the printing quality.

Since the pair of head press plate presses the top surface of the head support plate at the symmetric position with respect to the boundary line that divides the platen into two sections perpendicular to the platen, even if the errors of the mechanical precision of the respective components and the assembling precision thereof are accumulated or the platen is slated relative to the supporting frame, the rear end portion of the head support plate is swingably movably engaged with the stationary supporting shaft within the allowable range defined by the clearance. Therefore, the head support plate is pressed to follow the slant angle of the platen, and it is possible to uniformly press the printing head over the full length of the platen.

Since the holder for the roll of the printing paper is provided on the operable member, it is possible to easily and simply carry out the operation for loading the recording paper.

Furthermore, according to the present invention, in the recording operation in which the operable member is closed, the printing head is automatically pressed against the platen at a predetermined pressure by the pressure spring and upon the completion of the printing operation, the printing head is separated away from the platen. Accordingly, it is possible to avoid the deformation of the platen caused by the substantial pressure of the printing head against the platen for a long period of time.

Also, during the printing operation, since the operable member is prevented from opening by the locking member, there is no fear at all that the operable member would be opened accidentally in the printing operation. It is possible to continue the printing without any trouble and to ensure the high printing quality.

Also, the locking operation by either of the pressure spring and the locking member may be released by the pressure release cam or the locking change cam. It is possible to smoothly carry out the replacement and loading of the recording paper and to prevent the platen from being damaged.

What is claimed is:

1. A recording apparatus comprising:

a head support plate having a front end portion and a rear end portion, said head supporting plate being rotatably engaged at said rear end portion with a clearance relative to a supporting shaft fixed to a supporting frame;

a printing head provided at said front end portion of said head support plate;

an operable member rotatably connected to said supporting frame;

a platen rotatably provided on said operable member and facing said printing head when said operable member is held in a closed position;

a regulating plate integrally formed with said head support plate and provided to be contactable with a shaft of said platen or a bearing provided on said operable member for rotatably supporting said shaft of said platen when said operable member is held in the closed position;

an actuating lever rotatably mounted on said supporting frame and engaging with a part of said head support plate;

a regulating portion provided on said operable member and contactable with said actuating lever when said operable member is held in the closed position; and a biasing spring laid among said supporting frame, said head support plate and said actuating lever for biasing a spring force in a direction in which said printing head is brought into elastic contact with said platen through said head support plate and in a direction in which said regulating plate is biased toward said shaft of said platen or said bearing when said operable member is held in the closed position, and at the same time for biasing the spring force in a direction in which said printing head is separated away from said platen through said head support plate when said operable member is held in an opened position.

2. The recording apparatus according to claim 1, wherein said operable member is provided with a holder for a roll of recording paper.

3. The recording apparatus according to claim 1, further comprising a pressure means for pressing said head support plate so as to elastically contact said printing head against said platen when said operable member is held in the closed position.

4. The recording apparatus according to claim 3, wherein said pressure means is rotatably provided on said supporting frame and provided with a pair of head press plates for pressing a top surface of said head support plate at a symmetrical position with respect to a boundary line that divides said platen into two sections perpendicular to an axial direction of said platen.

5. The recording apparatus according to claim 4, further comprising:

a pressure spring for biasing said head press plates in a direction in which said printing head is elastically contacted with said platen through said head support plate;

a pressure change cam for switching said head press plates between a pressure position in which they engage with said head support plate and a pressure release position in which they are separated away from said head support plate; and a driving means for drivingly rotating said pressure change cam and holding its position in order to switch said head press plates to said pressure position in which said head press plates are engaged with said head support plate while receiving a recording start signal and for drivingly rotating said pressure change cam in order to change said head press plates to the pressure release position away from said head support plate in accordance with the completion of the recording operation.

6. The recording apparatus according to claim 5, wherein a locking member engaged at a first end portion with said operable member for restricting the opening of said operable member relative to said supporting frame is rotatably mounted on said supporting frame, and a locking change cam engaged with a second end portion of said locking member upon the engagement between the pressure change cam and said head press plates and releasing the engagement between said first end portion of said locking member and said operable member is provided.

* * * * *